US009345927B2

(12) United States Patent
Chang

(10) Patent No.: US 9,345,927 B2
(45) Date of Patent: May 24, 2016

(54) FEET STRETCHING DEVICE CAPABLE OF DYNAMICALLY ADJUSTING STRETCHING ANGLE UPON USER DEMAND

(71) Applicant: SOLID FOCUS INDUSTRIAL CO., LTD., Taoyuan (TW)

(72) Inventor: Shu-Wei Chang, Taoyuan (TW)

(73) Assignee: SOLID FOCUS INDUSTRIAL CO., LTD., Taoyuan (TW)

( * ) Notice: Subject to any disclaimer, the term of this patent is extended or adjusted under 35 U.S.C. 154(b) by 5 days.

(21) Appl. No.: 14/593,079

(22) Filed: Jan. 9, 2015

(65) Prior Publication Data

US 2016/0107025 A1 Apr. 21, 2016

(30) Foreign Application Priority Data

Oct. 15, 2014 (TW) ..... 103135638 A

(51) Int. Cl.

| | |
|---|---|
| ***A63B 23/08*** | (2006.01) |
| ***A63B 23/10*** | (2006.01) |
| ***A61H 1/00*** | (2006.01) |
| ***A61H 1/02*** | (2006.01) |
| ***A61H 5/00*** | (2006.01) |
| *A63B 23/00* | (2006.01) |

(52) U.S. Cl.

CPC ..... *A63B 23/08* (2013.01); *A61H 1/0266* (2013.01); *A63B 21/4015* (2015.10); *A63B 2023/006* (2013.01)

(58) Field of Classification Search

CPC ..... A63B 21/002; A63B 21/0023; A63B 21/0058; A63B 21/0059; A63B 21/4015; A63B 21/4047; A63B 23/08; A63B 23/10; A63B 23/0458; A63B 2023/006; A61H 1/0266

See application file for complete search history.

(56) References Cited

U.S. PATENT DOCUMENTS

| | | | | |
|---|---|---|---|---|
| 2002/0183662 | A1* | 12/2002 | Lu | A61H 1/003 601/28 |
| 2002/0183663 | A1* | 12/2002 | Lu | A61H 1/003 601/28 |
| 2003/0073550 | A1* | 4/2003 | Hsu | A61H 1/005 482/142 |
| 2006/0240955 | A1* | 10/2006 | Pu | A61H 1/0266 482/79 |

* cited by examiner

*Primary Examiner* — Oren Ginsberg
(74) *Attorney, Agent, or Firm* — Bacon & Thomas, PLLC

(57) ABSTRACT

The present invention is to provide a feet stretching device, which includes a base placed on the ground; an extendable rod having an end fixed at a front edge of the base and the other end extended upward; a control device having a control panel fixed at the other end of the extendable rod, two control handles disposed at two sides of the control panel for being held by user's hands, and a control circuit for generating different output signals selected by the user; and a driving mechanism having an end pivotally linked with the base at a position near a back edge of the base and the other end movably and reciprocatingly mounted on a support plate, so as to dynamically kept the angle between the support plate and the base according to the output signal for performing a stretching exercise on user's feet standing on the support plate.

24 Claims, 5 Drawing Sheets

FEET STRETCHING DEVICE CAPABLE OF DYNAMICALLY ADJUSTING STRETCHING ANGLE UPON USER DEMAND

FIELD OF THE INVENTION

The present disclosure generally relates to a stretching device, more particularly to feet stretching device capable of dynamically adjusting stretching angle upon user demand.

BACKGROUND OF THE INVENTION

With age, the flexibility of muscles and joints of the body will become worse and worse for people. Therefore, people can exercise to soften the muscles and bones. For example, walking, jogging, hiking, biking or swimming, etc. However, for person who lives in the city or is busy for work, it is not easy to do the aforementioned exercises daily. If the person does not exercise for a long time, it is bound to cause the ligaments and the muscles near the joints stiff gradually and the flexibility of the body will be declined, so joint pain, back pain and other uncomfortable phenomenon are easily happened. In addition, the hyperplasia fiber may occur in the aforementioned injured parts during the rehabilitation process after the muscles or the tendons are injured. The hyperplasia fiber will make the tendons stiff and pain, thereby affecting activity of the joints.

Further, people usually do the stretching exercise to improve the flexibility of body effectively and decrease hyperplasia fiber. The stretching exercise mainly has the following benefits.

First, the tight muscles can cause speed of blood circulation to slow down. By stretching exercise, the flexibility of the muscles can be restored, so that circulation and metabolism can be effective and the waste accumulated in the muscles can be excreted from the body more quickly with assistance of water.

Second, before exercising, people can perform the stretching to prevent the muscles from breaking during the extreme sports due to excessive pulling. With regular stretching, it not only can increase flexibility and scalability of the muscles, but also can strengthen toughness of the tendons. By this, injured probability of the muscles can be declined significantly. After exercising, the stretching undergone could relieve generated stiffness due to the exercise, so as to help circulation and metabolism of waste and prevent from muscle soreness due to the excessive exercise.

Thirdly, the stretching can soften the tight muscles, tendons and joints so that pressure and deterioration on the joints can be relieved, and circulation of blood and lymph can be promoted to get rid of headaches, iciness and other conditions. The joints can also be squeezed during the stretching, thereby not only making the synovial fluid flow smoothly but also promoting metabolism of the softer tissues and repairing injury of the softer tissues, so as to relieve degradation of the cartilage.

In view of many benefits generated by the stretching exercise, many companies design various exercise equipment to assist people to do stretching exercise more conveniently, such as stretching stool. However, most of existing stretching stools can just be operated in single angle, or cannot be adjusted angle easily, so the user has to fix a required angle by himself or herself before doing stretching exercise on the existing stretching stool, and the user may easily become lazy and difficultly keep habit of exercise. Therefore, what is need is to design and manufacture the exercise equipment capable of providing a nice stretching function to enable the user to adjust different exercise modes easily upon user demand.

SUMMARY OF THE INVENTION

The traditional stretching exercise equipment has the above-mentioned problem, so the inventor develops a feet stretching device capable of dynamically adjusting the stretching angle upon user demand based on long-term research and experiment, whereby the inconvenience of traditional stretching exercise equipment can be solved.

An objective of the present disclosure is to provide a feet stretching device capable of dynamically adjusting a stretching angle upon user demand. The feet stretching device includes a base, an extendable rod, a control device, a driving mechanism and a support plate. The bottom portion of the base is placed on the ground. An end of the extendable rod is fixed at a front edge of the base, and other end of the extendable rod is extended upward. The control device includes a control panel, two control handles and a control circuit. The control panel is fixedly disposed at the other end of the extendable rod, and the two control handles are fixedly disposed at two sides of the control panel respectively and provided for user to hold by hands. The control panel is equipped with at least one display screen and at least one setting button, and the control handle is equipped with at least one control button. The control circuit is electrically connected with the display screen, the setting button and the control button respectively, to generate different output signals according to different input signals (such as time, angle, manual operation, function) selected by the user via the setting button and the control button, and then display the output signals on the display screen. Each of the output signals corresponds to an exercise mode. Moreover, an end of the driving mechanism is pivotally linked with the base at a position near a back edge of the base, and other end of the driving mechanism is movably and reciprocatingly mounted on the bottom portion of the support plate, whereby the driving mechanism can make different angle be kept between the support plate and the base according to an output signal of the control circuit, so as to dynamically perform a stretching exercise on user's feet in different angle. Therefore, the user just operates the control device to enable the feet stretching device to act in a suitable exercise mode, and the convenience in usage can be efficiently improved.

Another objective of the present disclosure is that the support plate further includes a photointerrupter safety switch electrically connected with the control circuit, and the photointerrupter safety switch can stop each of the sport modes executed by the control circuit and restore the support plate to an initial status when a plurality of loopholes disposed on the support plate are not shielded totally. Therefore, when the user does not poise on the support plate yet or cannot stand on the support plate due to a wrong operation, the support plate will be restored to an initial status immediately or after keeping for a predetermined time, so as to prevent the user from being injured.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
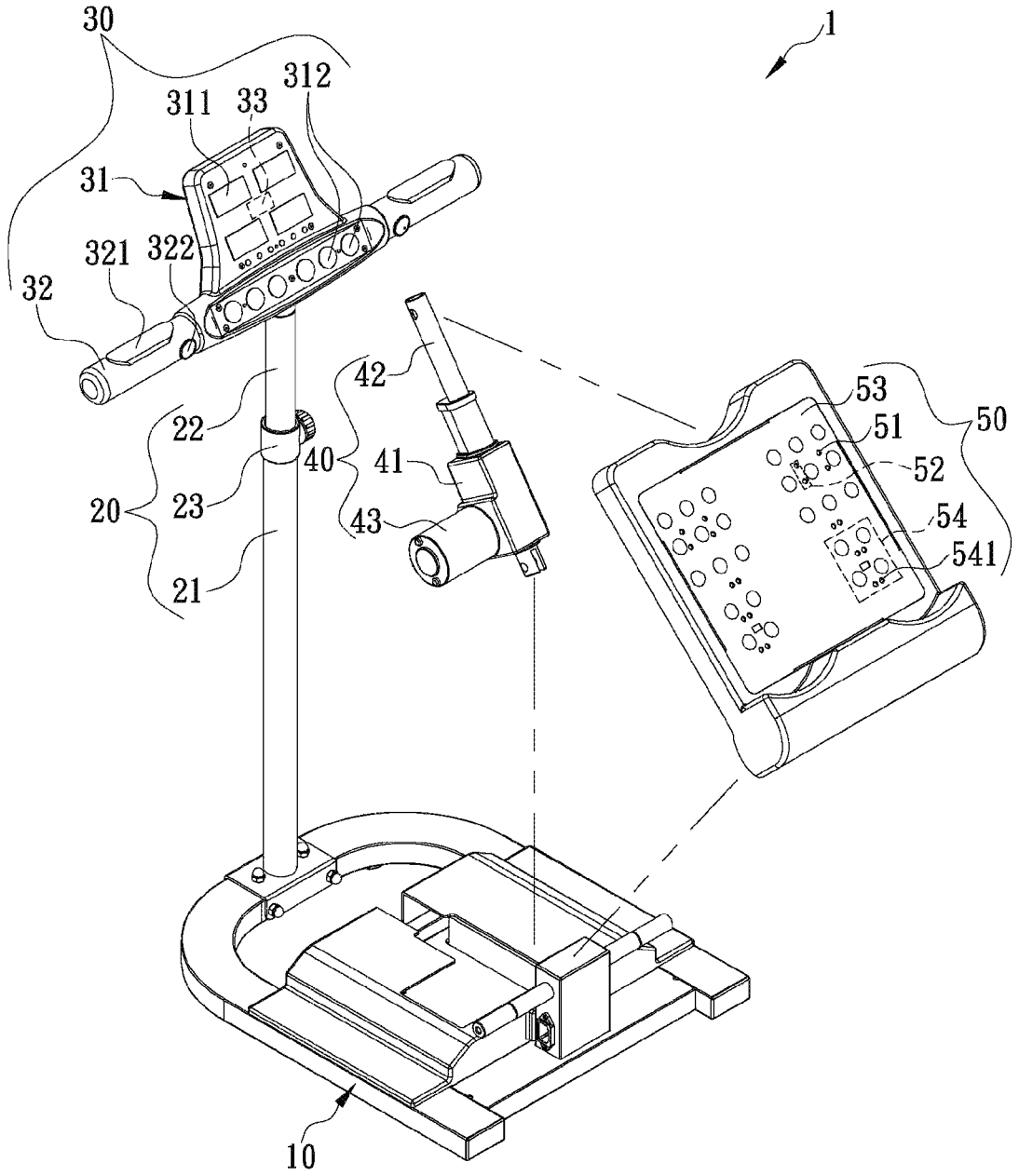
FIG. 1 is an exploded perspective view of the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

The present disclosure illustrates a feet stretching device capable of dynamically adjusting a stretching angle upon user demand. Please refer to FIG. 1 and FIG. 2. The feet stretching device 1 includes a base 10, an extendable rod 20, a control device 30, a driving mechanism 40 and a support plate 50. A bottom portion of the base 10 is placed on the ground, in this embodiment the bottom portion of the base 10 is in a plate shape, however, in other embodiment of the present disclosure the manufacturer can change the aspect of the base 10, and any base 10 which can be placed on the ground steadily is belonged to the so called base 10 of the present disclosure.

Figure 2:
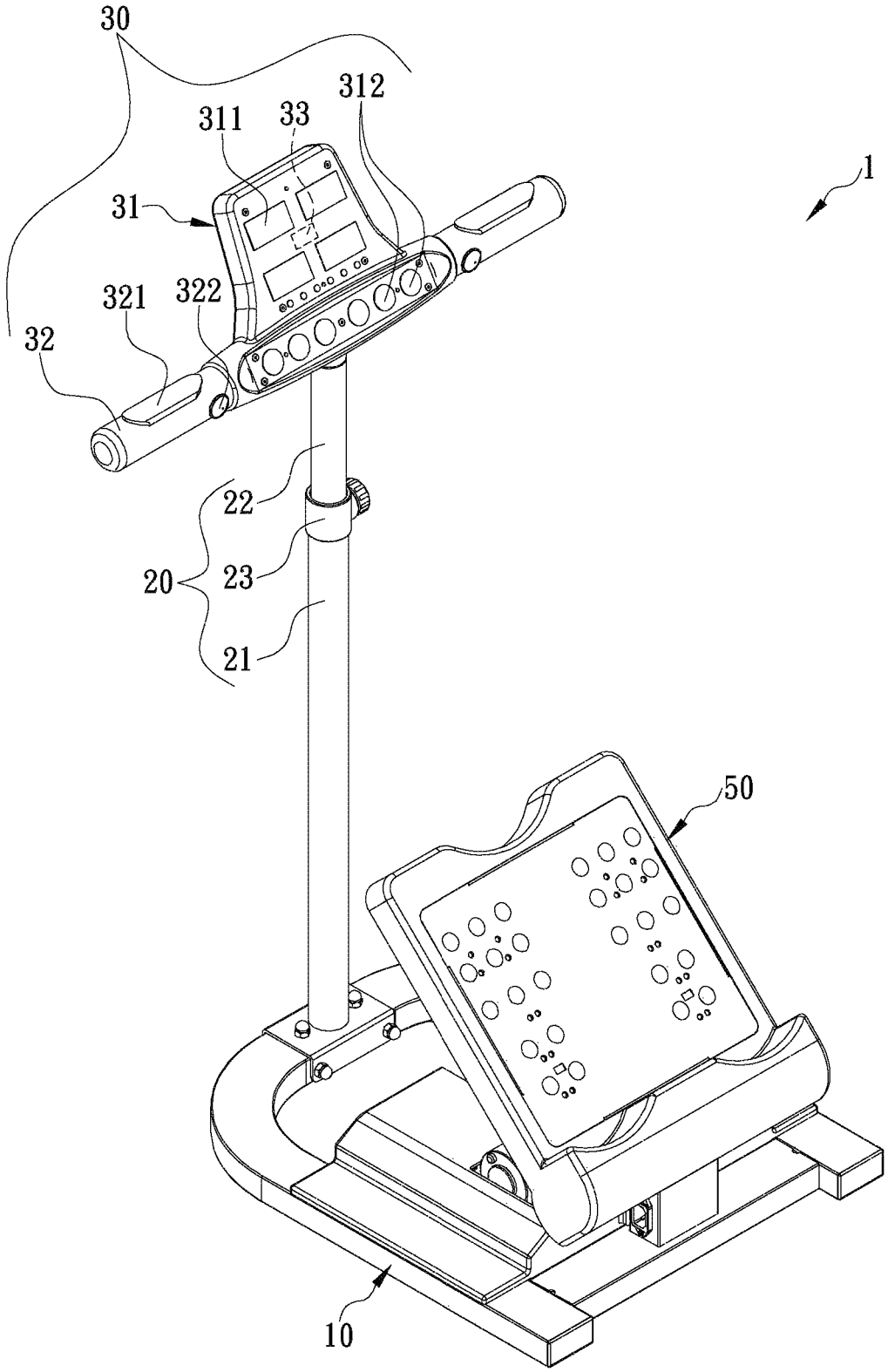
FIG. 2 is an assembly schematic view of the present disclosure.

As shown in FIG. 1 and FIG. 2, in the embodiment the extendable rod 20 includes at least one first rod 21, at least one second rod 22 and at least one positioning component 23. An end of the first rod 21 is fixed in a front edge of the base 10, other end of the first rod 21 is extended upward, an end of the second rod 22 is movably mounted inside other end of the first rod 21, and other end of the second rod 22 is also extended upward. The positioning component 23 is mounted at outside of the other end of the first rod 21, to make the first rod 21 and the second rod 22 be firmly and integratedly combined with each other. When the positioning component 23 is at a loose status, the second rod 22 and the first rod 21 can be moved relatively to adjust a whole length of the extendable rod 20. When the positioning component 23 is at a stress status, the second rod 22 and the first rod 21 cannot be moved relatively, so as to fix a current length of the extendable rod 20. Therefore, the user can adjust the whole length of the extendable rod 20 via the positioning component 23 to meet the user's height; however, in other embodiment of the present disclosure, the extendable rod 20 can be designed as an integrated formation, so as to reduce number of assembly component and manufacturing time.

As shown in FIG. 1 and FIG. 2, the control device 30 includes a control panel 31, two control handles 32 and a control circuit 33. The control panel 31 is fixedly disposed at the other end of the second rod 22, and the control handles 32 are fixedly disposed at two sides of the control panel 31 respectively and provided user to hold by hands. In the embodiment, the control panel 31 is equipped with a plurality of display screens 311 and a plurality of setting buttons 312 thereon, and the control handle 32 is equipped with a control button 322 and a heart pulse sensing piece 321 thereon. The control button 322 includes an angle up button and an angle down button. After the setting button 312 and the control button 322 are pressed, different input signals can be generated, for example, signal of time, angle, mode, etc. The heart pulse sensing piece 321 is configured for detecting the user's heart pulse to generate a heart pulse signal while the control handle 32 is held. However, in other embodiment of the present disclosure the manufacturer can arbitrarily adjust numbers and positions of the display screens 311, the setting button 312, the control button 322 and the heart pulse sensing piece 321 upon design demand; or, the control handle 32 can be not equipped with the heart pulse sensing piece 321. The control circuit 33 is electrically connected with the display screens 311, the setting button 312, the control button 322 and the heart pulse sensing piece 321, respectively. After the user operates the setting button 312 or the control button 322, the setting button 312 or the control button 322 transmits a corresponding input signal to the control circuit 33, and the heart pulse sensing piece 321 transmits the heart pulse signal to the control circuit 33. The control circuit 33 generates different output signals and displays the output signals on the display screen, so that the user can watch each of the plurality of display screens 311 to check a current status of the feet stretching device 1 or understand value of the current heart pulse. For example, after the user presses the angle up button or the angle down button, the control circuit displays the angle set via the angle up button or the angle down button on the display screen 311.

Figure 3:
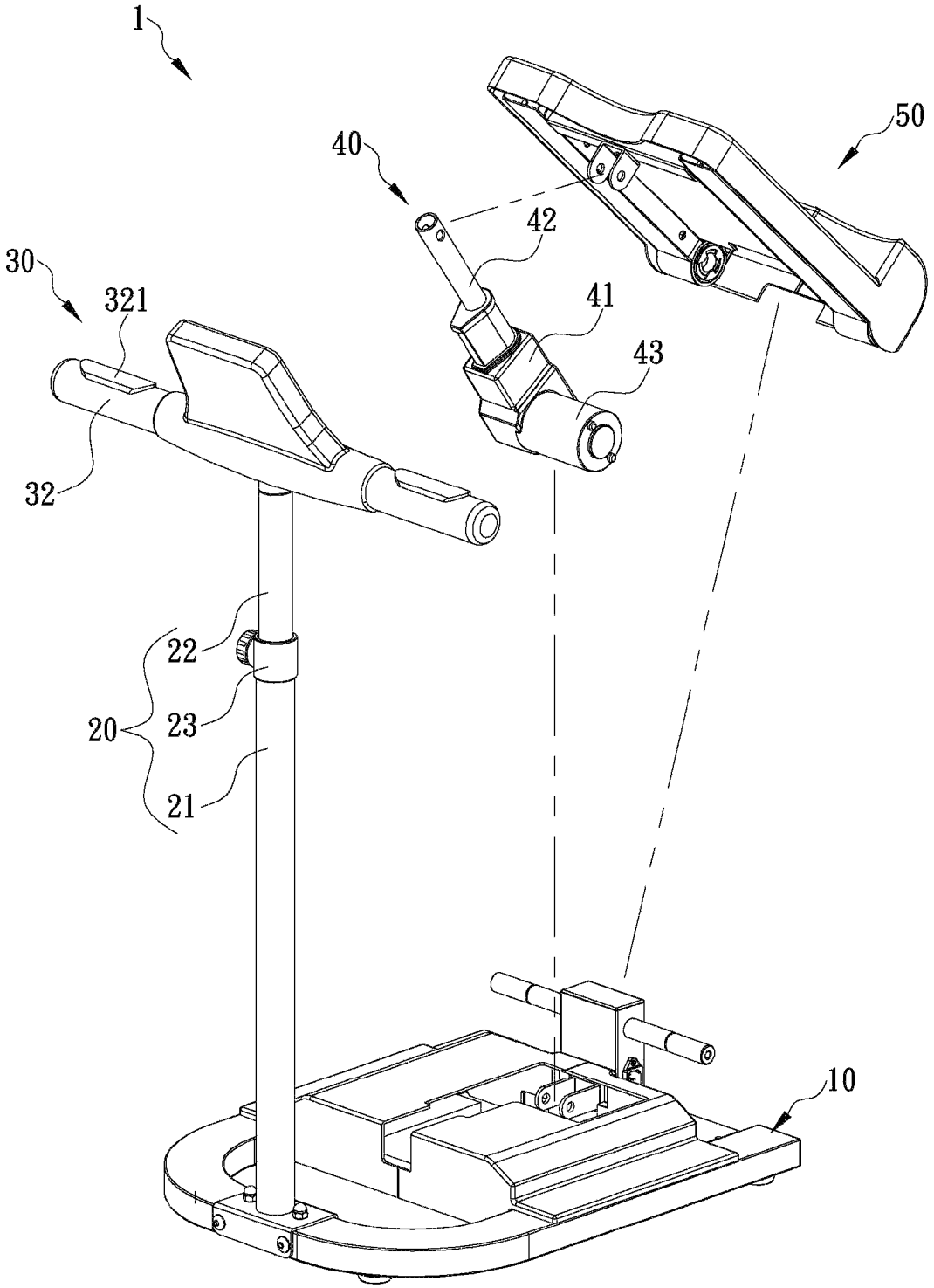
FIG. 3 is another exploded perspective view of the present disclosure.

As shown in FIG. 1 and FIG. 2, the driving mechanism 40 includes a driving seat 41, a linkage 42 and a motor 43. An end of the driving seat 41 is pivotally linked with the base 10 at a position near a back edge of the base 10, the linkage 42 is movably and reciprocatingly mounted on the driving seat 41, an end of the linkage 42 is extended into the driving seat 41, and other end of the linkage 42 is exposed out of other end of the driving seat 41. The motor 43 is fixed on the driving seat 41 and electrically connected with the control circuit 33, so that the motor can drive the linkage 42 by an output shaft thereof according to an output signal of the control circuit 33, to enable the other end of the linkage 42 to reciprocate at outside of the other end of the driving seat 41. Please refer to FIG. 3. A front edge of the bottom portion of the support plate 50 is pivotally linked with the other end of the linkage 42, a back edge of the bottom portion of the support plate 50 is pivotally linked with the base 10 at a position near the back edge of the base 10, a top surface of the support plate 50 is provided for being stood by the user's feet thereon. When the other end of the linkage 42 is reciprocated outside of the other end of the driving seat 41, the support plate 50 can maintain different angle to the base 10, to dynamically perform a stretching exercise on user's feet by different angles.

As shown in FIG. 1 and FIG. 2, the output signals generated by the control circuit 33 correspond to exercise modes respectively, and each of the exercise modes includes a set of driving signals for adjusting the angle dynamically and reciprocatingly in time order. The angle means an angle degree between the support plate 50 and the base 10, for example, the angle is adjusted from 0 degree to 5 degrees within first 20 seconds, from 3 degrees to 8 degrees within 20 seconds, from 5 degrees to 10 degrees within third 20 seconds, from 8 degrees to 13 degrees within fourth 20 seconds, and from 10 degrees to 15 degrees within fifth 20 seconds. After the angle is stopped at 15 degrees for 40 seconds, the angle is then adjusted from 15 degrees to 0 degree within 30 seconds. Therefore, these actions can be executed repeatedly to form the exercise mode. It should be noted that the above-mentioned exercise mode is just an embodiment, the user can arbitrarily design exercise mode having different content upon user demand. Preferably, in the exercise mode the maximum of the angle does not exceed 40 degrees for preventing the user's feet from pulling injury due to the too large angle.

Figure 4:
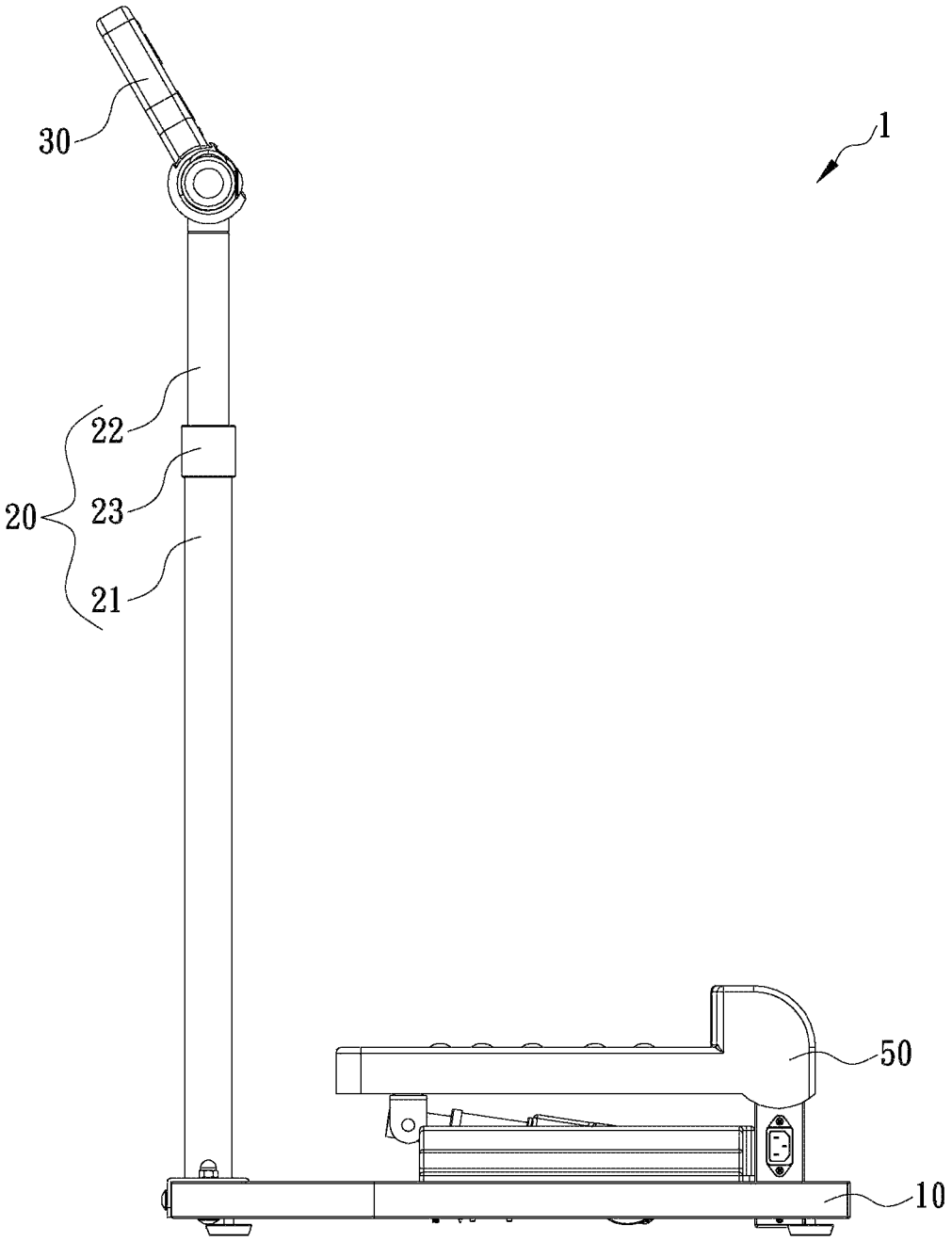
FIG. 4 is a schematic view of a using status of the present disclosure.
Figure 5:
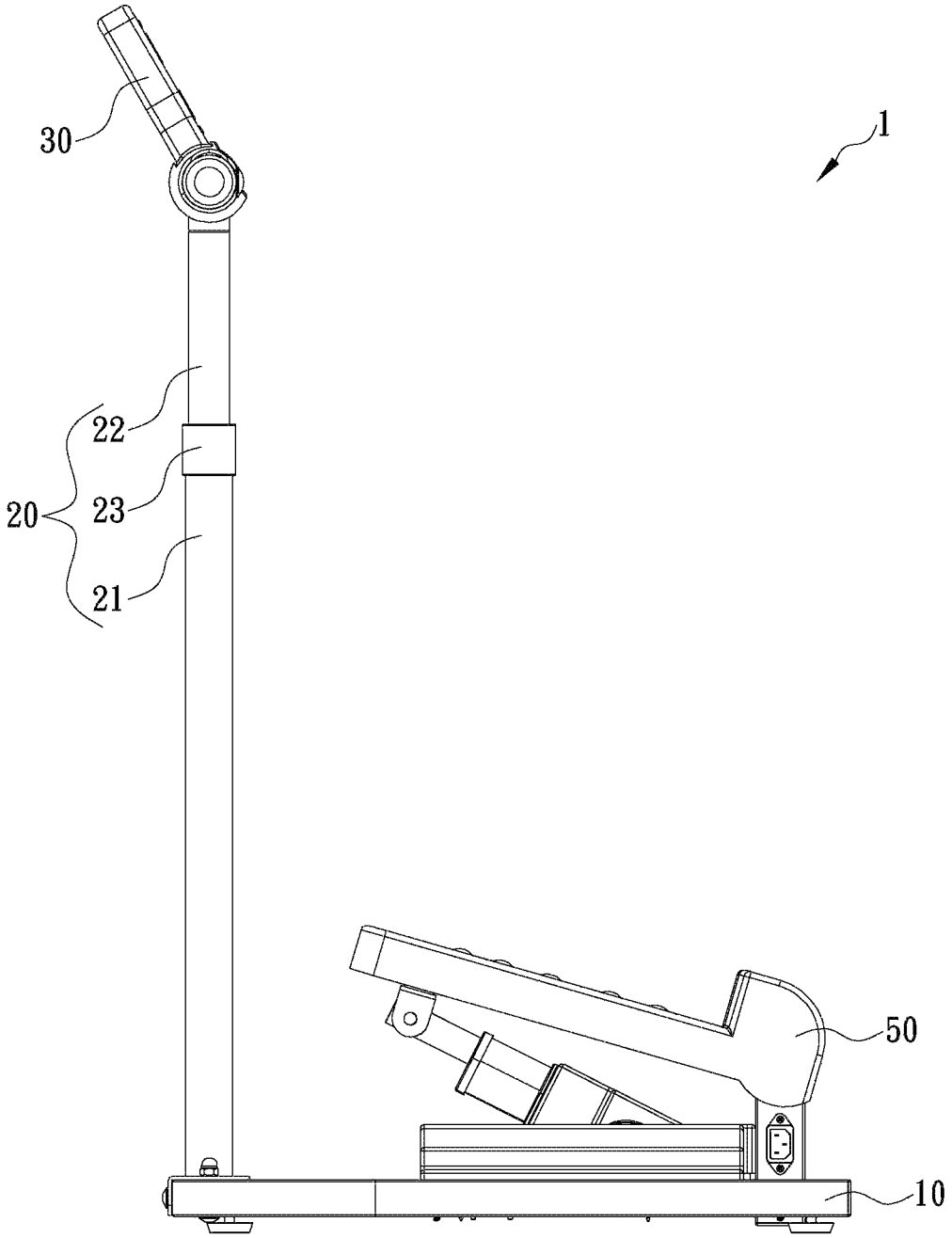
FIG. 5 is a schematic view of other using status of the present disclosure.

Please refer to FIG. 1, FIG. 4 and FIG. 5. The user can stand on the support plate 50 and operate the setting button 312 and the control button 322 to set various exercise modes upon user demand, so as to enable the support plate 50 to maintain different angle to the base 10 at different time point. For example, upon receipt of the input signal transmitted from the angle up button or the angle down button, the control circuit 33 drives the driving mechanism 40 according to the angle set by the input signal, to maintain the set angle between the support plate 50 and the base 10 (as shown in FIG. 5), so as to improve the stretching training effect of the set angle. Therefore, the user must not buy stretching devices with different angles, and the aforementioned adjusting manner is simple and can meet the user demand in exercise, and the convenience for the user to do stretching exercise is improved efficiently.

It is worth mentioning that in other embodiment of the present disclosure the support plate 50 is provided with a plurality of loopholes 51 thereon, a plurality of photointerrupter safety switches 52 inside and corresponding to the plurality of loopholes 51 respectively, in order to prevent the user from being injured because of falling from the driving mechanism 40 which is driven before the user stands on the support plate 50 firmly yet. The photointerrupter safety switches 52 are electrically connected with the control circuit 33, and when the loopholes 51 are not completely shielded by feet of the user, an interrupt signal is transmitted to the control circuit 33 to stop the exercise mode executed by the control circuit 33, and the support plate 50 is restored to an initial status (as shown in FIG. 4, 0 degree is maintained between the support plate 50 and the base 10). Therefore, when the support plate 50 is at the initial status, if the user does not shield the loopholes 51 due to incorrect stand posture, the driving mechanism 40 does not drive the support plate 50 to move. Or, when the user overrates his or her exercise ability and sets the angle between the support plate 50 and the base 10 too large, the user just moves one foot to leave original position for not shielding the loopholes 51, and the support plate 50 will be restored to the initial status to ensure user security. In addition, in other embodiment of the present disclosure, in order to improve security in use, the control circuit 33 controls the support plate 50 to maintain original angle for a predetermined time (such as 5 minutes) first when the user carelessly falls down and the loopholes 51 are not completely shielded during exercise, and the support plate 50 is then restored to the initial status, so the support plate 50 can be prevented from nipping user's limbs (such as hand or leg).

As shown in FIG. 1, the support plate 50 further includes a film type heating piece 53 which is electrically connected with the control circuit 33. The setting button 312 further includes a temperature setting button. When the user presses the temperature setting button, a temperature signal is transmitted to the control circuit 33, so the control circuit 33 can display the temperature set by the temperature setting button on the display screen 311, and drive the film type heating piece 53 to heat user's feet sole via the support plate 50 according to the set temperature, so as to relieve cool feeling at feet sole and improve blood circulation of feet sole. Moreover, apart from the above-mentioned film type heating piece 53, the manufacturer can also design the support plate 50 equipped with a far-infrared circuit board 54 inside, and the far-infrared circuit board 54 is electrically connected with the control circuit 33. The setting button 312 includes a far-infrared setting button. After the user presses the far-infrared setting button, a far infrared ray activating signal is transmitted to the control circuit 33. The control circuit then drives the far-infrared circuit board 54 to generate far infrared ray, so as to perform deeply heating on the user's feet via a plurality of far infrared ray holes disposed on the support plate 50, and to activate the blood circulation of the feet. Therefore, the muscle and meridian of the feet can be relaxed more easily and not tight any more, and the effect of stretching can be efficiently improved.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A feet stretching device capable of dynamically adjusting a stretching angle upon user demand, comprising:

a base having a bottom portion placed on the ground;

an extendable rod having an end fixed at a front edge of the base and the other end extended upward;

a control device comprising a control panel, two control handles and a control circuit, wherein the control panel is fixedly disposed at the other end of the extendable rod, the two control handles are fixedly disposed at two sides of the control panel, respectively, the control panel is equipped with at least one display screen and at least one setting button, each control handle is equipped with at least one control button, and the control circuit is electrically connected with the display screen, the setting button and the control button, respectively, to generate different output signals according to different input signals selected by the user via the setting button and the control button and then to display the output signal on the display screen;

a driving mechanism comprising a driving seat, a linkage and a motor, wherein an end of the driving seat is pivotally linked with the base at a position near a back edge of the base, the linkage is movably and reciprocatingly mounted on the driving seat, an end of the linkage is extended into the driving seat, the other end of the linkage is exposed out of the other end of the driving seat, the motor is fixed on the driving seat and electrically connected with the control circuit, whereby the motor can drive the linkage by an output shaft thereof according to an output signal of the control circuit, to enable the other end of the linkage to reciprocate at outside of the other end of the driving seat;

a support plate having a front edge of a bottom portion thereof pivotally linked with the other end of the linkage, and a back edge of the bottom portion pivotally linked with the base at a position near the back edge of the base, wherein a top surface of the support plate is provided for being stood by the user's feet thereon and, when the other end of the linkage is reciprocated outside of the other end of the driving seat, the support plate can maintain a different angle to the base.

2. The feet stretching device as defined in claim 1, wherein the extendable rod comprises:

at least one first rod, an end of the at least one first rod fixed at the front edge of the base, and the other end of the at least one first rod extended upward;

at least one second rod, an end of the at least one second rod movably mounted inside The other end of the first rod, and the other end of the second rod extended upward and linked to the control panel; and at least one positioning component, mounted to the outside of the other end of the first rod to enable the first rod and the second rod to firmly integrate with each other.

3. The feet stretching device as defined in claim 2, wherein each of the output signals corresponds to an exercise mode which comprises a set of driving signals for adjusting the angle dynamically and reciprocatingly in time order.

4. The feet stretching device as defined in claim 3, wherein a maximum of the angle does not exceed 40 degrees.

5. The feet stretching device as defined in claim 4, wherein the support plate further comprises a photointerrupter safety switch electrically connected with the control circuit, and the photointerrupter safety switch can stop each of the exercise modes executed by the control circuit to restore the support plate to an initial status when a plurality of loopholes disposed on the support plate are not shielded totally.

6. The feet stretching device as defined in claim 5, wherein the support plate further comprises a film type heating piece electrically connected with the control circuit, the setting button further comprises a temperature setting button, and the control circuit can display the temperature set by the temperature setting button on the display screen and drive the film type heating piece to heat the support plate according to the set temperature.

7. The feet stretching device as defined in claim 5, wherein the support plate further comprises a far-infrared circuit board electrically connected with the control circuit, the setting button further comprises a far-infrared setting button to trigger the control circuit to drive the far-infrared circuit board to generate a far infrared ray, and the generated far infrared ray is radiated via a plurality of far infrared ray holes disposed on the support plate.

8. The feet stretching device as defined in claim 5, wherein each control handle is further equipped with a heart pulse sensing piece which is electrically connected with the control circuit, the heart pulse sensing piece is configured for detecting a user's heart pulse while the user grips the control handles by hands, and the detected heart pulse is displayed on the display screen.

9. The feet stretching device as defined in claim 5, wherein the control button comprises an angle up button and an angle down button which are electrically connected with the control circuit, the control circuit can display the angle set by the angle up button or the angle down button on the display screen, and drive the driving mechanism according to the angle, to enable the support plate to maintain the set angle to the base.

10. The feet stretching device as defined in claim 3, wherein the support plate further comprises a photointerrupter safety switch electrically connected with the control circuit, and the photointerrupter safety switch can stop each of the exercise modes executed by the control circuit to restore the support plate to an initial status when a plurality of loopholes disposed on the support plate are not shielded totally.

11. The feet stretching device as defined in claim 10, wherein the support plate further comprises a film type heating piece electrically connected with the control circuit, the setting button further comprises a temperature setting button, and the control circuit can display the temperature set by the temperature setting button on the display screen and drive the film type heating piece to heat the support plate according to the set temperature.

12. The feet stretching device as defined in claim 10, wherein the support plate further comprises a far-infrared circuit board electrically connected with the control circuit, the setting button further comprises a far-infrared setting button to trigger the control circuit to drive the far-infrared circuit board to generate a far infrared ray, and the generated far infrared ray is radiated via a plurality of far infrared ray holes disposed on the support plate.

13. The feet stretching device as defined in claim 10, wherein each control handle is further equipped with a heart pulse sensing piece which is electrically connected with the control circuit, the heart pulse sensing piece is configured for detecting a user's heart pulse while the user grips the control handles by hands, and the detected heart pulse is displayed on the display screen.

14. The feet stretching device as defined in claim 10, wherein the control button comprises an angle up button and an angle down button which are electrically connected with the control circuit, the control circuit can display the angle set by the angle up button or the angle down button on the display screen, and drive the driving mechanism according to the angle, to enable the support plate to maintain the set angle to the base.

15. The feet stretching device as defined in claim 2, wherein the support plate further comprises a photointerrupter safety switch electrically connected with the control circuit, and the photointerrupter safety switch can stop each of the exercise modes executed by the control circuit to restore the support plate to an initial status when a plurality of loopholes disposed on the support plate are not shielded totally.

16. The feet stretching device as defined in claim 15, wherein the support plate further comprises a film type heating piece electrically connected with the control circuit, the setting button further comprises a temperature setting button, and the control circuit can display the temperature set by the temperature setting button on the display screen and drive the film type heating piece to heat the support plate according to the set temperature.

17. The feet stretching device as defined in claim 15, wherein the support plate further comprises a far-infrared circuit board electrically connected with the control circuit, the setting button further comprises a far-infrared setting button to trigger the control circuit to drive the far-infrared circuit board to generate a far infrared ray, and the generated far infrared ray is radiated via a plurality of far infrared ray holes disposed on the support plate.

18. The feet stretching device as defined in claim 15, wherein each control handle is further equipped with a heart pulse sensing piece which is electrically connected with the control circuit, the heart pulse sensing piece is configured for detecting a user's heart pulse while the user grips the control handles by hands, and the detected heart pulse is displayed on the display screen.

19. The feet stretching device as defined in claim 15, wherein the control button comprises an angle up button and an angle down button which are electrically connected with the control circuit, the control circuit can display the angle set by the angle up button or the angle down button on the display screen, and drive the driving mechanism according to the angle, to enable the support plate to maintain the set angle to the base.

20. The feet stretching device as defined in claim 1, wherein the support plate further comprises a photointerrupter safety switch electrically connected with the control circuit, and the photointerrupter safety switch can stop each of the exercise modes executed by the control circuit to restore the support plate to an initial status when a plurality of loopholes disposed on the support plate are not shielded totally.

21. The feet stretching device as defined in claim 20, wherein the support plate further comprises a film type heating piece electrically connected with the control circuit, the setting button further comprises a temperature setting button, and the control circuit can display the temperature set by the temperature setting button on the display screen and drive the film type heating piece to heat the support plate according to the set temperature.

22. The feet stretching device as defined in claim 20, wherein the support plate further comprises a far-infrared circuit board electrically connected with the control circuit, the setting button further comprises a far-infrared setting button to trigger the control circuit to drive the far-infrared circuit board to generate a far infrared ray, and the generated far infrared ray is radiated via a plurality of far infrared ray holes disposed on the support plate.

23. The feet stretching device as defined in claim 20, wherein each control handle is further equipped with a heart pulse sensing piece which is electrically connected with the control circuit, the heart pulse sensing piece is configured for detecting a user's heart pulse while the user grips the control handles by hands, and the detected heart pulse is displayed on the display screen.

24. The feet stretching device as defined in claim 20, wherein the control button comprises an angle up button and an angle down button which are electrically connected with the control circuit, the control circuit can display the angle set by the angle up button or the angle down button on the display screen, and drive the driving mechanism according to the angle, to enable the support plate to maintain the set angle to the base.

* * * * *